US009186889B2

(12) United States Patent
Kubo et al.

(10) Patent No.: US 9,186,889 B2
(45) Date of Patent: Nov. 17, 2015

(54) IMAGE FORMING APPARATUS

(71) Applicants: Isao Kubo, Tokoname (JP); Hidenobu Kondo, Nagoya (JP); Kyoichi Morita, Anjo (JP); Hideki Arimoto, Nagoya (JP); Takahiro Ikeno, Aichi-ken (JP)

(72) Inventors: Isao Kubo, Tokoname (JP); Hidenobu Kondo, Nagoya (JP); Kyoichi Morita, Anjo (JP); Hideki Arimoto, Nagoya (JP); Takahiro Ikeno, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/845,883

(22) Filed: Mar. 18, 2013

(65) Prior Publication Data

US 2013/0257972 A1 Oct. 3, 2013

(30) Foreign Application Priority Data

Mar. 30, 2012 (JP) ..... 2012-079718

(51) Int. Cl.
*B41J 29/38* (2006.01)
*B41J 2/045* (2006.01)
*B41J 29/393* (2006.01)

(52) U.S. Cl.
CPC ..... *B41J 2/04548* (2013.01); *B41J 29/393* (2013.01)

(58) Field of Classification Search
USPC ..... 347/5, 9, 12, 23, 37
See application file for complete search history.

(56) References Cited

U.S. PATENT DOCUMENTS

| | | | | |
|---|---|---|---|---|
| 5,834,857 | A | 11/1998 | Abe et al. | |
| 5,914,538 | A | 6/1999 | Kurosawa et al. | |
| 6,390,596 | B1 * | 5/2002 | Jeon | 347/37 |
| 6,837,558 | B2 * | 1/2005 | Kaburagi | 347/5 |
| 7,278,705 | B2 * | 10/2007 | Ohara | 347/23 |
| 2004/0227970 | A1 | 11/2004 | Ohara | |

FOREIGN PATENT DOCUMENTS

| | | | |
|---|---|---|---|
| JP | 7-087734 | A | 3/1995 |
| JP | 7-298612 | A | 11/1995 |
| JP | 2004-358963 | A | 12/2004 |

* cited by examiner

*Primary Examiner* — Lam Nguyen
(74) *Attorney, Agent, or Firm* — Scully, Scott, Murphy & Presser, P.C.

(57) ABSTRACT

An image forming apparatus may be configured to enter a first state where electric power is supplied from a power supply and a second state where no electric power is supplied from the power supply. A capacitor may be connected to the power supply, and may be charged by the power supply in the first state. A controller may be connected to the capacitor, and may operate with electric power supplied from the capacitor in the second state. The controller may operate with electric power supplied from the power supply in the first state. The controller may cause the image forming apparatus to enter the first state upon detecting that the image forming apparatus is in a predetermined state. The controller may acquire the related information and may cause the image forming apparatus to enter the second state.

11 Claims, 9 Drawing Sheets

IMAGE FORMING APPARATUS

CROSS-REFERENCE TO RELATED APPLICATIONS

This application claims priority to Japanese Patent Application No. 2012-079718, filed on Mar. 30, 2012, the contents of which are hereby incorporated by reference into the present application.

TECHNICAL FIELD

This specification relates to power-saving of an image forming apparatus.

DESCRIPTION OF RELATED ART

Demands for saving power consumption of an image forming apparatus have been increasing. In the related art, an image forming apparatus which can be driven while switching between a sleep mode where power consumption is low and a normal mode where power consumption is high is known.

In the sleep mode, it is necessary to supply electric power to circuits which need to operate even during the sleep mode, such as a circuit that monitors an apparatus state. Thus, it may be difficult to further progress power-saving of the image forming apparatus due to the electric power consumed in the sleep mode. In this specification, a technique capable of solving such a problem is provided.

One technique disclosed in the present application is an image forming apparatus. The image forming apparatus may be configured to enter a first state where electric power is supplied from a power supply to various circuits and a second state where no electric power is supplied from the power supply to the circuits. The image forming apparatus may comprise a capacitor and a controller. The capacitor may be connected to the power supply, and may be charged by the power supply in a period where the image forming apparatus is in the first state. The controller may be connected to the capacitor. The controller may operate with electric power supplied from the capacitor when the image forming apparatus is in the second state. The controller may operate with electric power supplied from the power supply when the image forming apparatus is in the first state. The controller may be configured to perform (A) causing the image forming apparatus to enter the first state upon detecting that the image forming apparatus is in a predetermined state when the image forming apparatus is in the second state. The controller may be configured to perform (B) reading instruction information stored in a memory after the image forming apparatus has entered the first state. The controller may be configured to perform (C) acquiring related information relating to the image forming apparatus when the instruction information instructs to acquire the related information. The controller may be configured to perform (D) causing the image forming apparatus to enter the second state after the above (C).

EMBODIMENT

<Configuration of Image Forming Apparatus>

Figure 1:
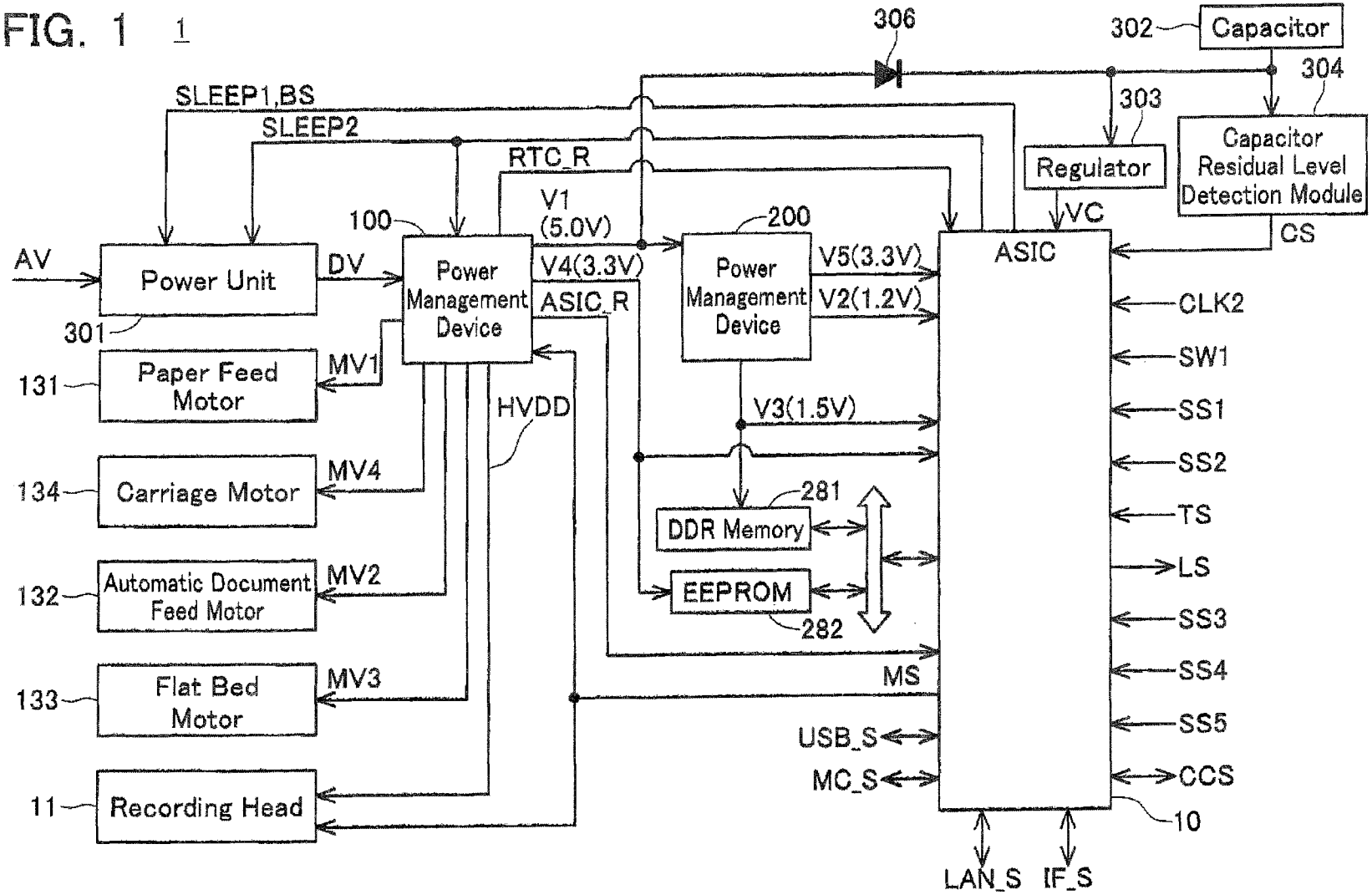
FIG. 1 shows a block diagram showing a control configuration of an image forming apparatus.

FIG. 1 is a block diagram showing a control configuration of an image forming apparatus 1 according to this specification. The image forming apparatus 1 is an image forming apparatus that uses an ink jet recording head. As shown in FIG. 1, an image forming apparatus 1 includes a power unit 301, power management devices 100 and 200, an application specific integrated circuit (ASIC) 10, a recording head 11, a paper feed motor 131, an automatic document feed motor 132, a flat bed motor 133, a carriage motor 134, a capacitor 302, a regulator 303, a capacitor residual level detection module 304, a diode 306, a DDR memory 281, and an EEPROM 282.

The power unit 301 is a circuit that converts an input AC power AV into a DC voltage DV and outputs the DC voltage DV. Moreover, the power unit 301 receives a boot-up signal BS, a 0V sleep signal SLEEP1, and an 8V sleep signal SLEEP2. The power unit 301 supplies a 31V DC voltage DV upon receiving an instruction (that is, the boot-up signal BS) to enter a normal mode. The power unit 301 stops supplying the DC voltage DV upon receiving an instruction (that is, the 0V sleep signal SLEEP1) to enter a second sleep mode. The power unit 301 supplies the 8V DC voltage DV upon receiving an instruction (that is, the 8V sleep signal SLEEP2) to enter a first sleep mode.

The power management devices 100 and 200 are formed as separate integrated circuits (ICs). The power management devices 100 and 200 are complex ICs that include a motor driving module for driving various motors such as the paper feed motor 131 and a DC/DC converter for supplying electric power.

The configuration of the power management device 100 will be described. The power management device 100 receives the DC voltage DV. The power management device 100 outputs a voltage V1 (5.0V), a voltage V4 (3.3V), an ASIC reset signal ASIC_R, an RTC reset signal RTC_R, a voltage HVDD, and voltages MV1 to MV4. The voltage V1 is input to the power management device 200. Moreover, the voltage V1 is input to the capacitor 302, the regulator 303, and the capacitor residual level detection module 304 via the diode 306. The voltage V4 is input to the ASIC 10 and the EEPROM 282. The ASIC reset signal ASIC_R is input to the ASIC 10. The ASIC reset signal ASIC_R is a signal for stopping circuits other than an RTC unit 310 of the ASIC 10. The RTC reset signal RTC_R is input to the ASIC 10. The RTC reset signal RTC_R is a signal for restarting the RTC unit 310 when an error occurs, for example. The voltage HVDD is input to the recording head 11. The voltages MV1 to MV4 are input to the paper feed motor 131 to the carriage motor 134, respectively.

The configuration of the power management device 200 will be described. The power management device 200 receives the voltage V1. The power management device 200 outputs a voltage V2 (1.2V), a voltage V3 (1.5V), and a voltage V5 (3.3V). The voltages V2 and V5 are input to the ASIC 10. The voltage V3 is input to the ASIC 10 and the DDR memory 281.

The capacitor 302 is connected to a cathode terminal of the diode 306, the regulator 303, and the capacitor residual level detection module 304. The regulator 303 outputs a voltage VC regulated to a predetermined voltage, which is input to the ASIC 10. A signal CS output from the capacitor residual level detection module 304 is input to the ASIC 10. The capacitor residual level detection module 304 is a module that outputs the signal CS to inform the ASIC 10 of a decrease in the residual level upon detecting that the residual charge level of the capacitor 302 becomes smaller than a predetermined level.

In the normal mode and the first sleep mode, the capacitor 302 is charged with the voltage V1. Moreover, the regulator 303 operates with the voltage V1. On the other hand, in the second sleep mode, since the voltage V1 is not supplied from the power management device 100, electric power is supplied from the capacitor 302 to the regulator 303. The regulator 303 generates the voltage VC based on the electric power from the capacitor 302 and outputs the voltage VC to the ASIC 10. Since the diode 306 is reverse biased, no electric power is supplied from the capacitor 302 to the power management device 200. Moreover, the capacitor residual level detection module 304 monitors the residual level of the capacitor 302.

The capacitor 302 is an electric double-layer capacitor. The electric double-layer capacitor is also called a supercapacitor (registered trademark), a gold capacitor (registered trademark), or an ultracapacitor. In the electric double-layer capacitor, during charging, electrolyte ions present between two opposite-polarity electrodes are caused to be aligned on the surfaces of the two electrodes according to electrostatic interaction, and an electric double layer is formed. During discharging, the alignment disappears. Since no chemical reaction occurs during charging and discharging, the electric double-layer capacitor has such a property that electrodes are substantially not deteriorated and the capacitor can be used over a long period of time. Further, the electric double-layer capacitor has such a property that it can be charged and discharged in a shorter time than secondary batteries. Furthermore, the electric double-layer capacitor has such a property that a larger amount of charge can be charged and discharged than electrolytic capacitors.

The EEPROM 282 is a nonvolatile memory. The EEPROM 282 stores a periodic maintenance flag, a temperature detection flag, an I/F connection change flag, a cartridge change flag, a jam flag, I/F connection information, cartridge information CCS, and a charge period.

The periodic maintenance flag is information that instructs to execute a periodic maintenance process (S152). The temperature detection flag is information that instructs to execute an ink temperature detection process (S116). The I/F connection change flag is a flag that is stored when I/F connection is changed, and a process for dealing with the change has not been executed. The cartridge change flag is a flag that is stored when an ink cartridge 340 is not properly mounted. The jam flag is a flag that is stored when paper jam of a document or a recording sheet occurs.

The I/F connection information is information on whether there is an apparatus connected via one of a USB host I/F 341, a USB I/F 342, and a LAN_I/F 343 or information that includes information on the connected apparatus. The cartridge information CCS is information on an ink color, a residual ink level, and the like of the ink cartridge 340. The charge period is a period in which the image forming apparatus 1 is maintained in the normal mode or the first sleep mode in order to charge the capacitor 302. The charge period may be long enough to complete charging of the capacitor 302. The charge period may be determined in advance by a manufacturer or the like of the image forming apparatus 1.

The DDR memory 281 is a volatile memory. The DDR memory 281 communicates various types of data with the ASIC 10. The paper feed motor 131 is a motor for feeding a printing sheet to a recording position. The automatic document feed motor 132 is a motor for continuously feeding a plurality of sheets of document sheet. The document sheet herein refers to a page of an original to be scanned and the like. The flat bed motor 133 is a motor for moving a reading unit. The carriage motor 134 is a motor for moving a carriage that performs printing in a scanning direction in a reciprocating manner. The recording head 11 is a component that discharges ink contained in the ink cartridge 340 to the printing sheet according to an ink jet method so as to perform recording. The recording head 11 is mounted on the carriage.

Figure 2:
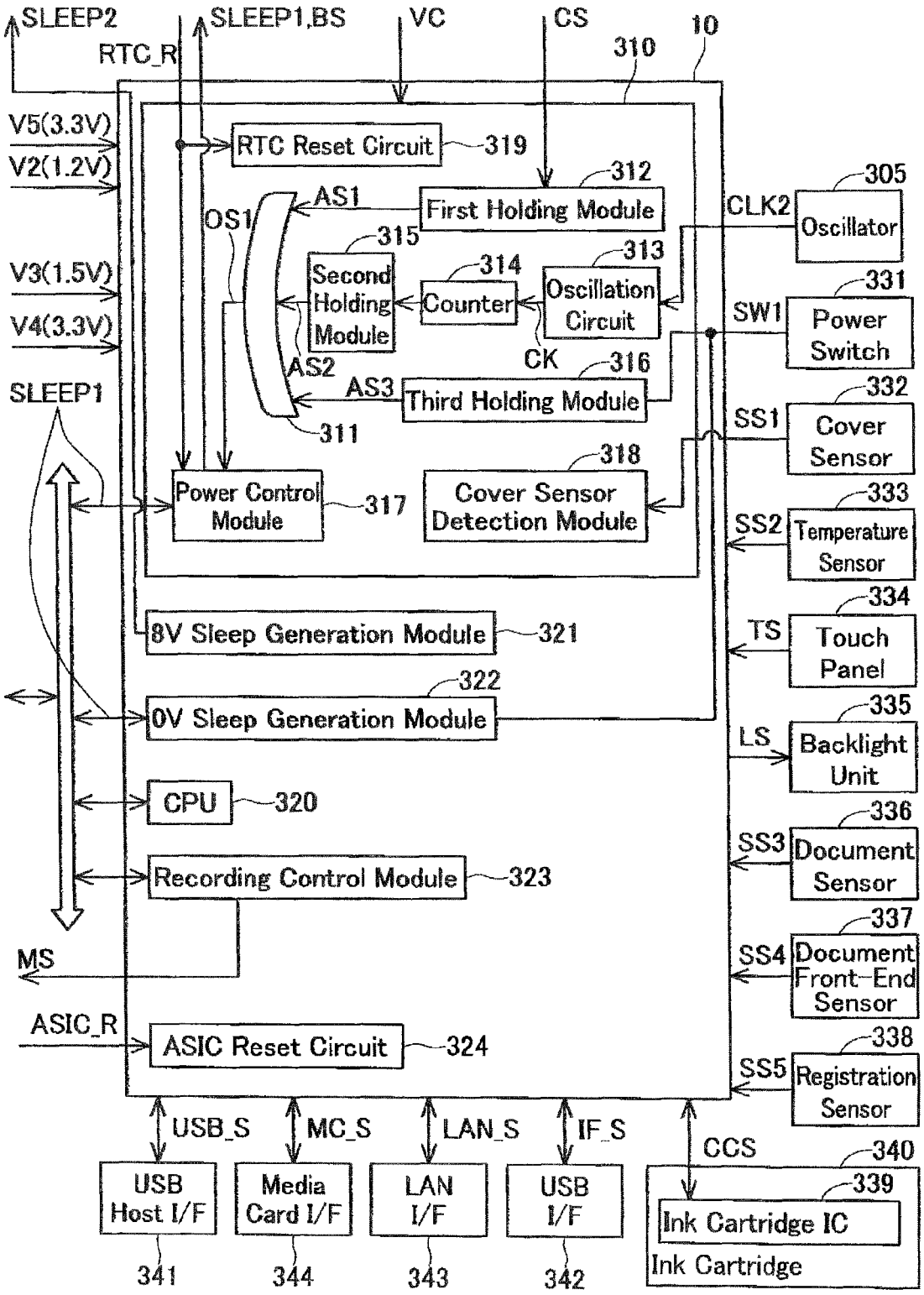
FIG. 2 shows a block diagram showing the control configuration of the image forming apparatus.

An internal configuration of the ASIC 10 and various circuits connected to the ASIC 10 will be described with reference to FIG. 2. The ASIC 10 is an application specific integrated circuit that generates a control signal for controlling various circuits. The ASIC 10 may be a system IC or an LSI.

A central processing unit (CPU) 320 is a circuit that performs information processing associated with image formation. An 8V sleep generation module 321 outputs the 8V sleep signal SLEEP2. The 8V sleep signal SLEEP2 is input to the power unit 301. The 0V sleep generation module 322 receives a signal SW1. The 0V sleep generation module 322 outputs the 0V sleep signal SLEEP1. The 0V sleep signal SLEEP1 is input to the power unit 301. A recording control module 323 outputs a signal MS. The signal MS is input to the power management device 100 and the recording head 11. The recording control module 323 communicates with the DDR memory 281 and the EEPROM 282 via dedicated buses, respectively. An ASIC reset circuit 324 receives the ASIC reset signal ASIC_R.

The real-time clock (RTC) unit 310 will be described. The voltage VC from the regulator 303 is supplied to the RTC unit 310. On the other hand, the voltages V2 to V5 are supplied to the ASIC 10. Thus, in the normal mode and the first sleep mode, the entire ASIC 10 including the RTC unit 310 operates. On the other hand, in the second sleep mode, the RTC unit 310 only operates.

The RTC unit 310 includes an OR circuit 311, a first holding module 312, an oscillation circuit 313, a counter 314, a second holding module 315, a third holding module 316, a power control module 317, and a cover sensor detection module 318. The first holding module 312 stores a charge flag upon receiving the signal CS indicating that the residual charge level of the capacitor 302 has become smaller than a predetermined level. Moreover, the first holding module 312 outputs a high-level notification signal AS1 to the OR circuit 311. The oscillation circuit 313 receives a clock signal CLK2. The oscillation circuit 313 outputs a clock signal CK based on the clock signal CLK2. The clock signal CK is input to the counter 314.

The counter 314 executes count-up based on the input clock signal CK. Moreover, the counter 314 includes a register (not shown). Various apparatus information detection times can be set to the register of the counter 314. Due to this, the counter 314 can detect such an event that the apparatus information detection time set to the register has arrived.

Examples of the apparatus information detection time set to the register of the counter 314 includes ink temperature detection time, I/F connection change time, cartridge change time, jam detection time, and periodic maintenance time. The ink temperature detection time is the time determined based on an execution cycle of a process of measuring an ink temperature of the ink cartridge 340 using a temperature sensor 333. The I/F connection change time is the time determined based on an execution cycle of a process (S212) of acquiring the IT connection information. The cartridge change time is the time determined based on an execution cycle of a process (S312) of acquiring the cartridge information CCS. The jam detection time is the time determined based on an execution cycle of a process (S412) of acquiring information from various sensors. The periodic maintenance time is the time determined based on an execution cycle of a periodic maintenance process (S152) described later. The periodic maintenance time is the time that can be changed by a process (S118) of updating the periodic maintenance process described later. The I/F connection change time, the cartridge change time, and the jam detection time are set to a cycle that is shorter than the ink temperature detection time. The cycle of the I/F connection change time, the cartridge change time, and the jam detection time may be 15 minutes, for example. The cycle of the ink temperature detection time may be 3 hours, for example. The periodic maintenance time is set to a cycle that is longer than the ink temperature detection time. The cycle of the periodic maintenance time may be 30 days, for example.

The second holding module 315 stores a counter flag upon receiving a notification, indicating that the apparatus information detection time has arrived, from the counter 314. Moreover, the second holding module 315 outputs a high-level notification signal AS2 to the OR circuit 311.

The third holding module 316 stores a power ON flag upon receiving the signal SW1 indicating that an input of a start instruction by the user is received. Moreover, the third holding module 316 outputs a high-level notification signal AS3 to the OR circuit 311.

The OR circuit 311 receives the notification signals AS1 to AS3. The OR circuit 311 outputs a signal OS1 which is input to the power control module 317. When any one of the notification signals AS1 to AS3 has a high level, the signal OS1 is set at a high level. The power control module 317 receives the signal OS1 and the reset signal RTC_R. The power control module 317 outputs the 0V sleep signal SLEEP1 and the boot-up signal BS. The cover sensor detection module 318 receives a signal SS1.

The ASIC 10 is further connected to an oscillator 305, a power switch 331, a cover sensor 332, the temperature sensor 333, a touch panel 334, a backlight unit 335, a document sensor 336, a document front-end sensor 337, a registration sensor 338, the ink cartridge 340, the USB host I/F 341, the USB-I/F 342, the LAN_I/F 343, and a media card I/F 344.

The oscillator 305 outputs the clock signal CLK2 to the ASIC 10. The power switch 331 is a switch that accepts a user instruction to start the image forming apparatus 1. The power switch 331 outputs the signal SW1 to the ASIC 10. The cover sensor 332 is a sensor that detects an open/close state of the cover of the ink cartridge 340. The cover sensor 332 outputs the signal SS1 to the ASIC 10. The temperature sensor 333 is a sensor that measures the temperature of ink stored in the ink cartridge 340. The temperature sensor 333 may be an NTC thermistor, for example. The temperature sensor 333 outputs a signal SS2 to the ASIC 10. The touch panel 334 outputs a signal TS to the ASIC 10. The backlight unit 335 is a light source that illuminates the panel of the touch panel 334 from the backside. The backlight unit 335 operates in the normal mode. The ASIC 10 outputs a signal LS to the backlight unit 335. The document sensor 336 is a sensor that detects whether a document is set on an automatic document feeder (not shown). The document sensor 336 outputs a signal SS3 to the ASIC 10. The document front-end sensor 337 is a sensor that detects the front end of a document sheet. The document front-end sensor 337 outputs a signal SS4 to the ASIC 10. The registration sensor 338 is a sensor that detects the front end of a recording sheet. The registration sensor 338 outputs a signal SS5 to the ASIC 10.

The ink cartridge 340 is a portion that contains ink used in image formation. The ink cartridge 340 includes an ink cartridge IC 339. The ink cartridge IC 339 is an IC that stores the cartridge information CCS. The cartridge information CCS is information on the ink color, the residual ink level, or the like of the cartridge. The ASIC 10 communicates the cartridge information CCS with the ink cartridge IC 339.

The USB host I/F 341 and the USB_I/F 342 are I/Fs that perform USB connection. The ASIC 10 communicates a signal USB_S with the USB host I/F 341. Moreover, the ASIC 10 communicates a signal IF_S with the USB_I/F 342. The LAN_I/F 343 is an I/F that performs LAN connection. The ASIC 10 communicates a signal LAN_S with the LAN_I/F 343. The media card I/F 344 is an I/F that performs connection with various storage cards that have a nonvolatile memory. The ASIC 10 communicates a signal MC_S with the media card I/F 344.

<Operation of Image Forming Apparatus 1>

The operation of the image forming apparatus 1 will be described. In the image forming apparatus 1, the carriage motor 231 moves a carriage (not shown) having the recording head 11 that discharges ink to perform recording in a reciprocating manner. Specifically, when the carriage motor 231 rotates in the forward and backward directions, the carriage moves along a guide shaft (not shown) in a reciprocating manner. Moreover, when the paper feed motor 131 is driven, a printing paper is fed by a paper feeding mechanism (not shown) and is transported to a recording position, and at the recording position, ink is discharged to the surface of the printing paper from the recording head 11, whereby recording is performed.

Moreover, the image forming apparatus 1 has the normal mode, the first sleep mode, and the second sleep mode. In the normal mode, the 31V DC voltage DV is supplied from the power unit 301. In the normal mode, the paper feed motor 131 and the like can be driven. In the first sleep mode, the 8V DC voltage DV is supplied from the power unit 301. In the first sleep mode, no electric power is supplied to various motors such as the paper feed motor 131. In the second sleep mode, the supply of the DC voltage DV from the power unit 301 is stopped. In the second sleep mode, electric power is supplied to only the RTC unit 310, the capacitor residual level detection module 304, the power switch 331, and the oscillator 305. In the second sleep mode, the RTC unit 310 receives electric power from the capacitor 302 rather than from the power unit 301.

<Power Control Process>

The power control process performed by the ASIC 10 will be described with reference to the flowcharts of FIGS. 3 to 10. The power control process is a process that the CPU 320 performs by using software-based control.

Figure 3:
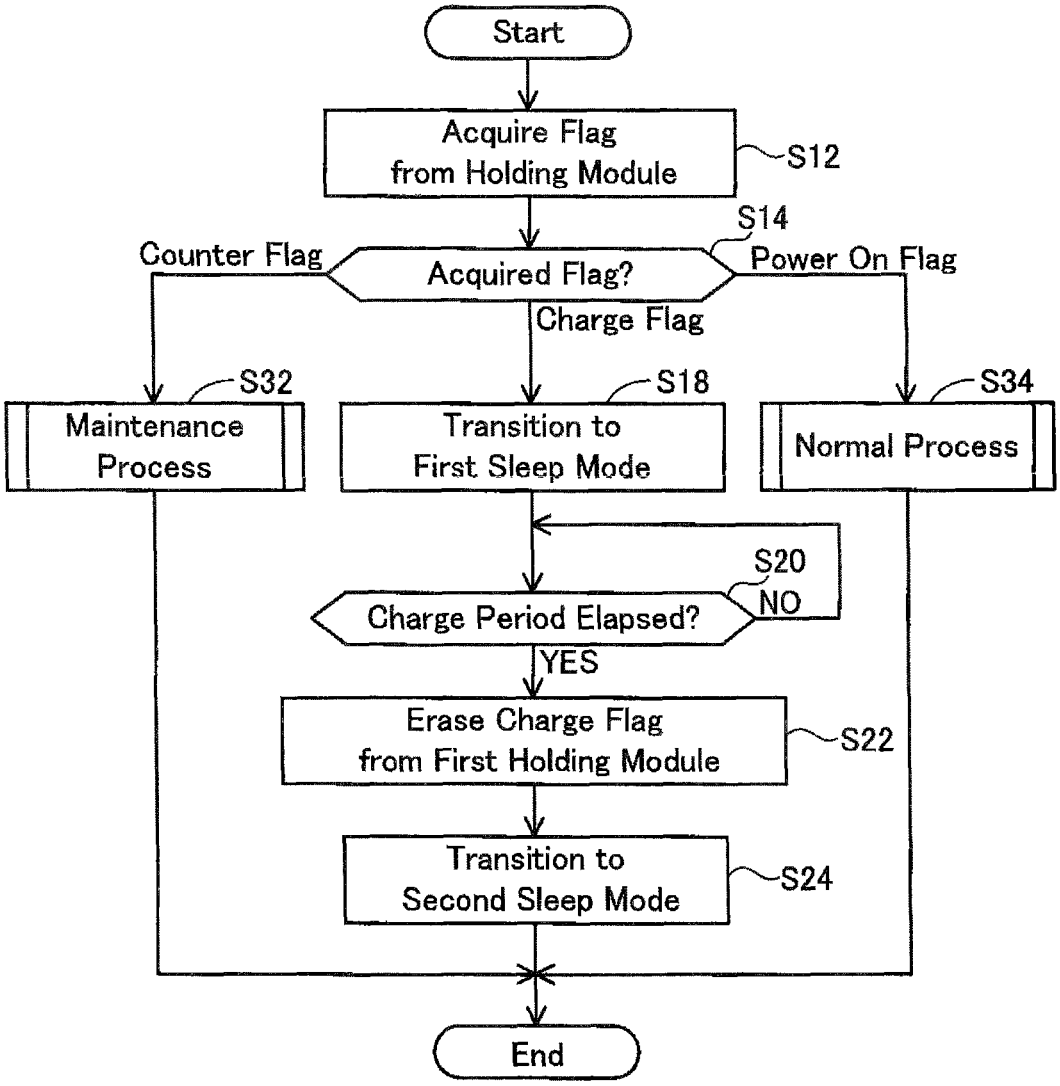
FIGS. 3 to 9 show flowcharts of a power control process.

The flow of FIG. 3 starts when the image forming apparatus 1 enters the normal mode from the second sleep mode. The transition from the second sleep mode to the normal mode occurs when it is detected that the image forming apparatus 1 is in any one of the first to third predetermined states. The first predetermined state is a state where the residual charge level of the capacitor 302 has become smaller than a predetermined level. The second predetermined state is a state where the maintenance process is required. The third predetermined state is a state where a start instruction is input from the power switch 331. The first to third predetermined states are detected by the RTC unit 310. Specifically, the first to third predetermined states are detected when any one of the notification signals AS1 to AS3 has a high level, and the signal OS1 output from the OR circuit 311 transitions to a high level. When the first to third predetermined states are detected, the power control module 317 sends the boot-up signal BS to the power unit 301, instructing to supply the 31V DC voltage DV. As a result, the image forming apparatus 1 enters the normal mode from the second sleep mode.

In S12, the CPU 320 acquires a flag that is stored in any one of the first, second, and third holding modules 312, 315, and 316. In S14, the CPU 320 judges whether the acquired flag is the charge flag (stored in the first holding module 312), the counter flag (stored in the second holding module 315), or the power ON flag (stored in the third holding module 316).

When the charge flag is acquired (S14: charge flag), the flow proceeds to S18. In S18, the CPU 320 causes the 8V sleep generation module 321 to output the 8V sleep signal SLEEP2 to the power unit 301. As a result, the image forming apparatus 1 enters the first sleep mode from the normal mode. In S20, the CPU 320 judges whether the charge period has elapsed. When the charge period has not elapsed (S20: NO), the flow returns to S20. When the charge period has elapsed (S20: YES), the flow proceeds to S22. In S22, the CPU 320 erases the charge flag stored in the first holding module 312. In S24, the CPU 320 causes the 0V sleep generation module 322 to output the 0V sleep signal SLEEP1 to the power unit 301. As a result, the image forming apparatus 1 enters the second sleep mode from the first sleep mode. In this way, the flow ends.

On the other hand, when it is judged in S14 that the counter flag is acquired (S14: counter flag), the flow proceeds to S32. In S32, the CPU 320 executes the maintenance process. The content of the maintenance process will be described later. In this way, the flow ends.

Moreover, when it is judged in S14 that the power ON flag is acquired (S14: power ON flag), the flow proceeds to S34. In S34, the CPU 320 executes normal process. The content of the normal process will be described later. In this way, the flow ends.

Figure 4:
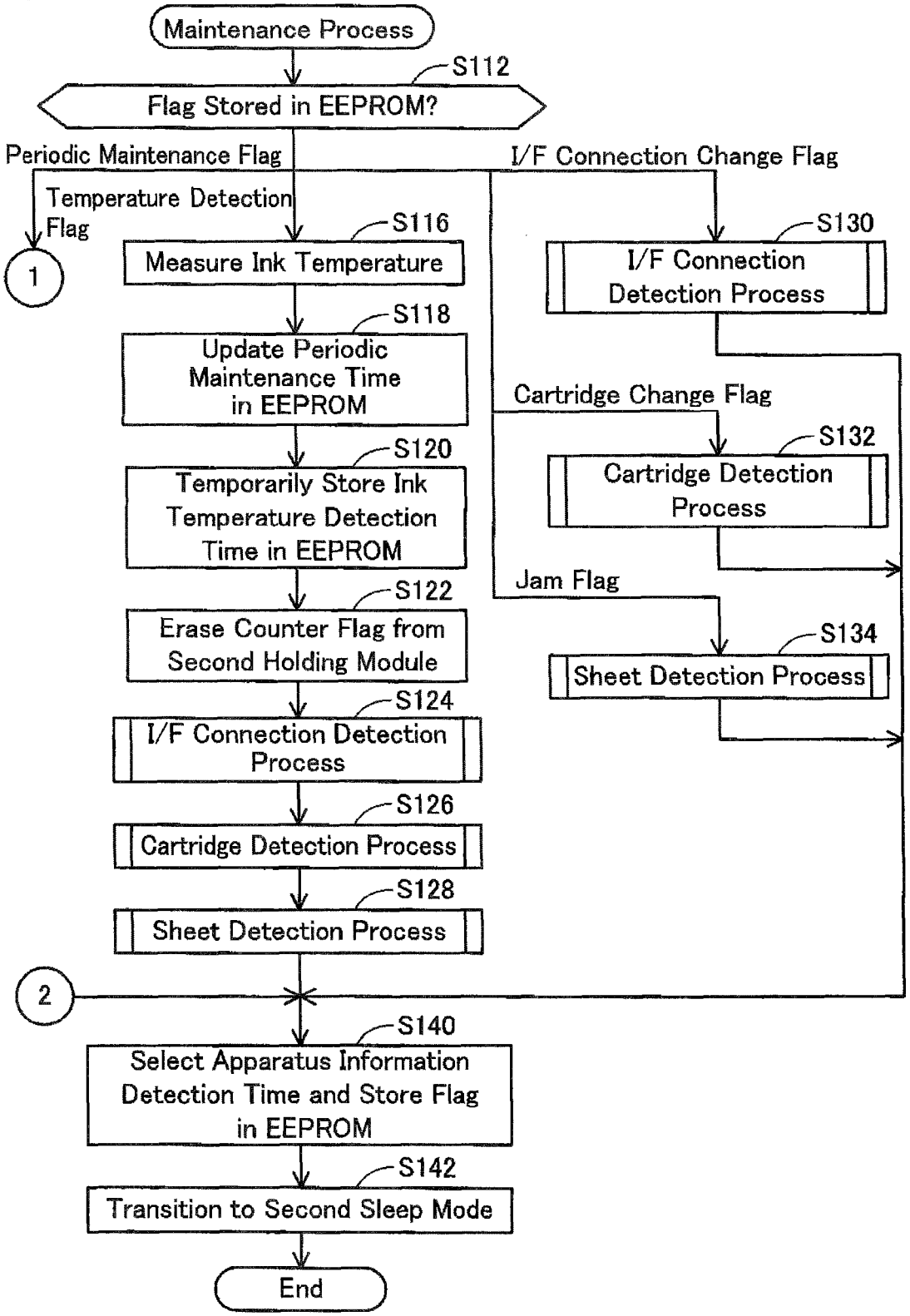

The maintenance process (S32) will be described with reference to FIG. 4. In S112, the CPU 320 reads the flag stored in the EEPROM 282. Examples of the type of the flag read in S112 include a periodic maintenance flag, a temperature detection flag, an I/F connection change flag, a cartridge change flag, and a jam flag. Moreover, a process corresponding to the type of the read flag is executed. Due to this, it is possible to check from the flag which process is to be executed by the image forming apparatus 1 that has returned to the normal mode from the second sleep mode.

When the temperature detection flag is read in S112 (S112: temperature detection flag), the flow proceeds to S116. In S116, the CPU 320 measures the temperature of ink stored in the ink cartridge 340 using the temperature sensor 333.

In S118, the CPU 320 updates the periodic maintenance time stored in the EEPROM 282. Specifically, the next periodic maintenance time is adjusted so that the lower the ink temperature measured in S116, the earlier the next periodic maintenance time occurs. In S120, the CPU 320 temporarily stores the ink temperature detection time in the EEPROM 282 as a candidate for the apparatus information detection time that is to be stored in the counter 314. In S122, the CPU 320 erases the counter flag stored in the second holding module 315.

In S124, the CPU 320 executes an I/F connection detection process. The content of the I/F connection detection process will be described later. In S126, the CPU 320 executes a cartridge detection process. The content of the cartridge detection process will be described later. In S128, the CPU 320 executes a sheet detection process. The content of the sheet detection process will be described later.

In S140, the CPU 320 selects the earliest time among the times (candidate times for the apparatus information detection time to be stored in the counter 314) that are temporarily stored in the EEPROM 282. Examples of the times temporarily stored in the EEPROM 282 include ink temperature detection time (S120), periodic maintenance time (S154 and S118), I/F connection change time (S224), mismounting setting time (S324), and jam detection time (S434). Moreover, the CPU 320 stores the selected earliest time in the register of the counter 314 as apparatus information detection time.

Moreover, in S140, the CPU 320 stores a flag, for a process associated with the earliest time, in the EEPROM 282. Examples of the type of the flag stored in the EEPROM 282 includes a periodic maintenance flag, a temperature detection flag, an I/F connection change flag, a cartridge change flag, and a jam flag.

In S142, the CPU 320 causes the 0V sleep generation module 322 to output the 0V sleep signal SLEEP1 to the power unit 301. As a result, the image forming apparatus 1 enters the second sleep mode from the first sleep mode. In this way, the flow ends.

On the other hand, when the I/F connection change flag is read from the EEPROM 282 in S112 (S112: I/F connection change flag), the flow proceeds to S130. In S130, the CPU 320 executes an I/F connection detection process. The content of the I/F connection detection process will be described later. Moreover, when the cartridge change flag is read in S112 (S112: cartridge change flag), the flow proceeds to S132. In S132, the CPU 320 executes a cartridge detection process. The content of the cartridge detection process will be described later. Moreover, when the jam flag is read in S112 (S112: jam flag), the flow proceeds to S134. In S134, the CPU 320 executes a sheet detection process. The content of the sheet detection process will be described later.

Figure 5:
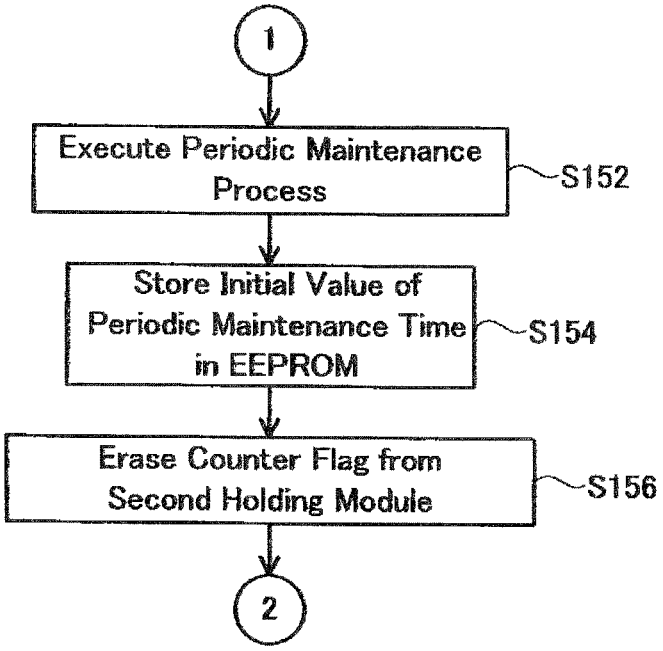

Moreover, when the periodic maintenance flag is read from the EEPROM 282 in S112 (S112: periodic maintenance flag), the flow proceeds to S152 (FIG. 5). In S152, the CPU 320 executes a periodic maintenance process. In the periodic maintenance process, a process of performing maintenance of nozzles of the recording head 11 such as purging or flushing may be executed, for example.

In S154, the CPU 320 stores an initial value (for example, 30 days after the previous periodic maintenance time) of the periodic maintenance time in the EEPROM 282 as the execution time of the next periodic maintenance process. In S156, the CPU 320 erases the counter flag stored in the second holding module 315. After that, the flow proceeds to S140 (FIG. 4).

Figure 6:
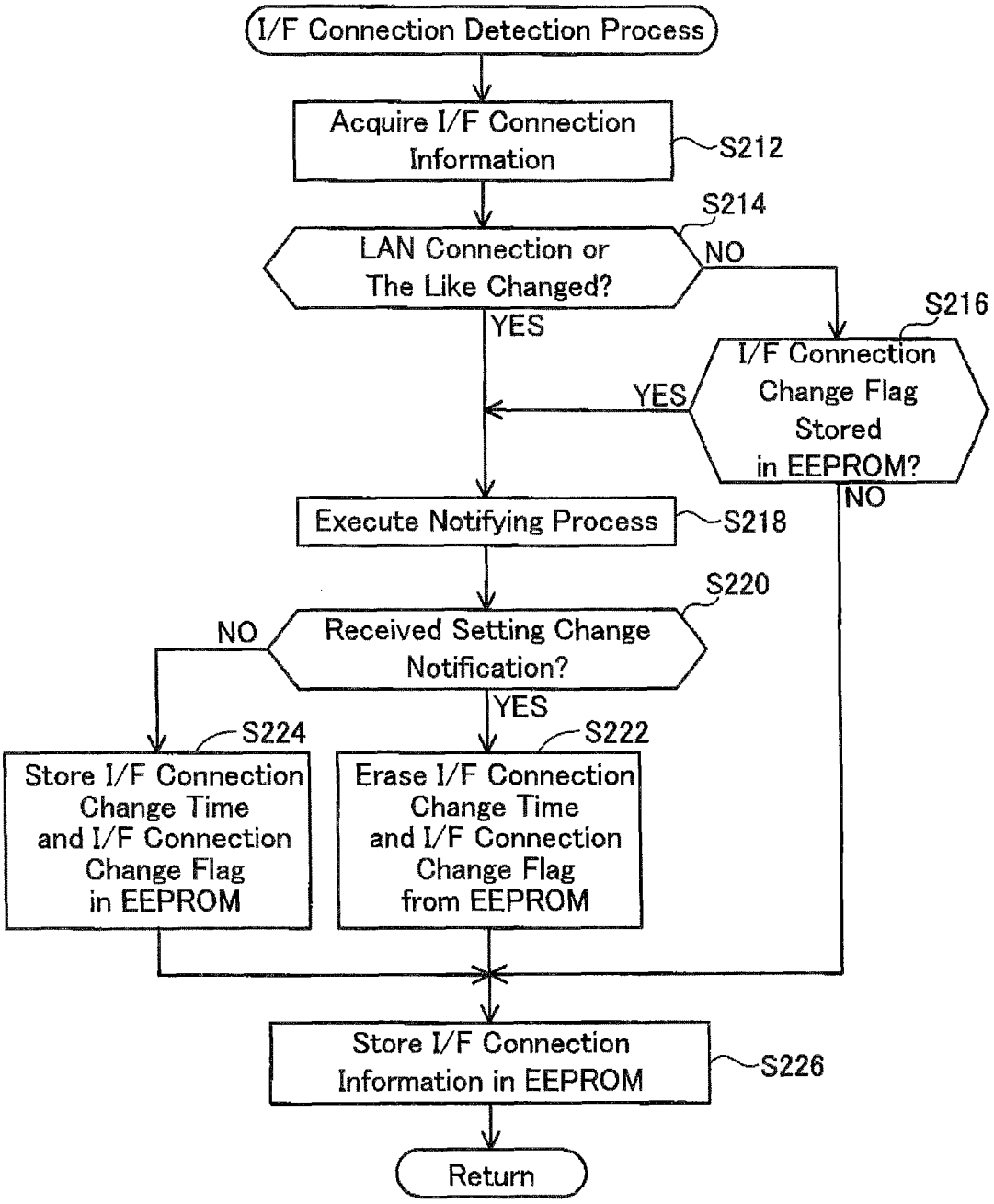

The I/F connection detection process performed in S124 and S130 will be described with reference to FIG. 6. In S212, the CPU 320 acquires I/F connection information from the USB host I/F 341, the USB-I/F 342, and the LAN_I/F 343. In S214, the CPU 320 judges whether LAN connection or USB connection has been changed. Specifically, it is judged whether the I/F connection information acquired in S212 is identical to the I/F connection information stored in the EEPROM 282. When the connection is changed (S214: YES), the flow proceeds to S218. When the connection is not changed (S214: NO), the flow proceeds to S216.

In S216, the CPU 320 judges whether the I/F connection change flag is stored in the EEPROM 282. When the I/F connection change flag is not stored (S216: NO), it is judged that a process for dealing with the change in the LAN connection or the USB connection has been executed, and the flow proceeds to S226. On the other hand, when the I/F connection change flag is stored (S216: YES), it is judged that a process for dealing with the change in the LAN connection or the USB connection has not been executed, and the flow proceeds to S218.

In S218, the CPU 320 executes a notifying process of outputting a message to the user to execute a process for dealing with the change in the LAN connection or the USB connection. The notifying process may display a character string "Please Turn On Apparatus Connected to Image Forming Apparatus," for example, on the touch panel 334. The notifying process may be performed for a predetermined period.

In S220, the CPU 320 judges whether a setting change notification is received from the apparatus connected to the image forming apparatus 1. For example, if a personal computer (PC) (not shown) is connected via the USB_I/F 342, the setting change notification may be received from the PC when the PC has completed reading driver information corresponding to the image forming apparatus 1. When the setting change notification is not received from a connection destination apparatus (S220: NO), the flow proceeds to S224. In S224, the CPU 320 temporarily stores the I/F connection change time (for example, after 15 minutes) in the EEPROM 282 as a candidate for the apparatus information detection time that is to be stored in the counter 314. Moreover, the CPU 320 stores the I/F connection change flag in the EEPROM 282.

On the other hand, when the setting change notification is received from a connection destination apparatus (S220: YES), the flow proceeds to S222. In S222, the CPU 320 erases the I/F connection change flag from the EEPROM 282. Moreover, the CPU 320 erases the I/F connection change time that is temporarily stored in the EEPROM 282. Then, the flow proceeds to S226, and the CPU 320 stores the I/F connection information in the EEPROM 282. In this way, the flow ends.

Figure 7:
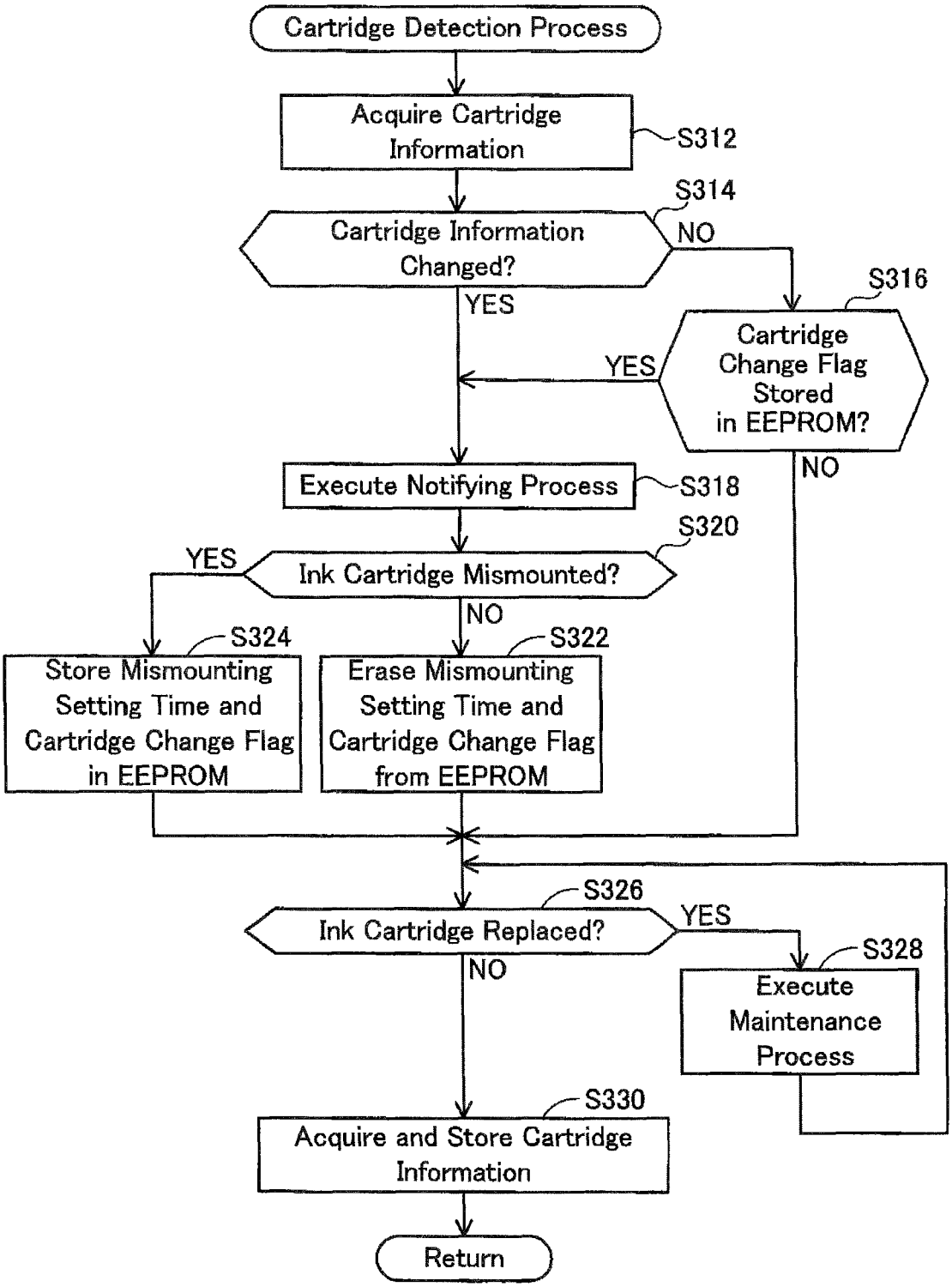

The cartridge detection process performed in S126 and 5132 will be described with reference to FIG. 7. In S312, the CPU 320 acquires cartridge information CCS from the ink cartridge IC 339. In S314, the CPU 320 judges whether the cartridge information has been changed. Specifically, it is judged whether the cartridge information acquired in S312 is identical to the cartridge information stored in the EEPROM 282. When the information is changed (S314: YES), the flow proceeds to S318. When the information is not changed (S314: NO), the flow proceeds to S316.

In S316, the CPU 320 judges whether the cartridge change flag is stored in the EEPROM 282. When the cartridge change flag is not stored (S316: NO), it is judged that the ink cartridge 340 is properly mounted, and the flow proceeds to S326. On the other hand, when the cartridge change flag is stored (S316: YES), it is judged that a process for dealing with replacement of the ink cartridge 340 has not been executed, and the flow proceeds to S318.

In S318, the CPU 320 executes a notifying process of outputting a message to the user to execute a process for dealing with replacement of the ink cartridge 340. The notifying process may display a character string "Please Check Ink Cartridge," for example, on the touch panel 334. Moreover, the notifying process may be performed for a predetermined period.

In S320, the CPU 320 judges whether the ink cartridge 340 is mismounted. An example of mismounting is the case where the color of a cartridge mounting portion is different from the color of a mounted cartridge. When the ink cartridge 340 is mismounted (S320: YES), the flow proceeds to S324. In S324, the CPU 320 temporarily stores the mismounting setting time (for example, after 15 minutes) in the EEPROM 282 as a candidate for the apparatus information detection time that is to be stored in the counter 314. Moreover, the CPU 320 stores the cartridge change flag in the EEPROM 282.

On the other hand, when the ink cartridge 340 is not mismounted (S320: NO), the flow proceeds to S322. In S322, the CPU 320 erases the cartridge change flag from the EEPROM 282. Moreover, the CPU 320 erases the mismounting setting time temporarily stored in the EEPROM 282. After that, the flow proceeds to S326.

In S326, the CPU 320 judges whether the ink cartridge 340 has been replaced. As an example of a method of judging whether the ink cartridge 340 has been replaced, it may be judged whether a residual ink level has been changed. When the ink cartridge 340 is replaced (S326: YES), the flow proceeds to S328, and the maintenance process (for example, purging or flushing) of the recording head 11 is executed. After that, the flow returns to S326. On the other hand, when the ink cartridge 340 is not replaced (S326: NO), the flow proceeds to S330. In S330, the CPU 320 acquires cartridge information CCS from the ink cartridge 340 and stores the same in the EEPROM 282. In this way, the flow ends.

Figure 8:
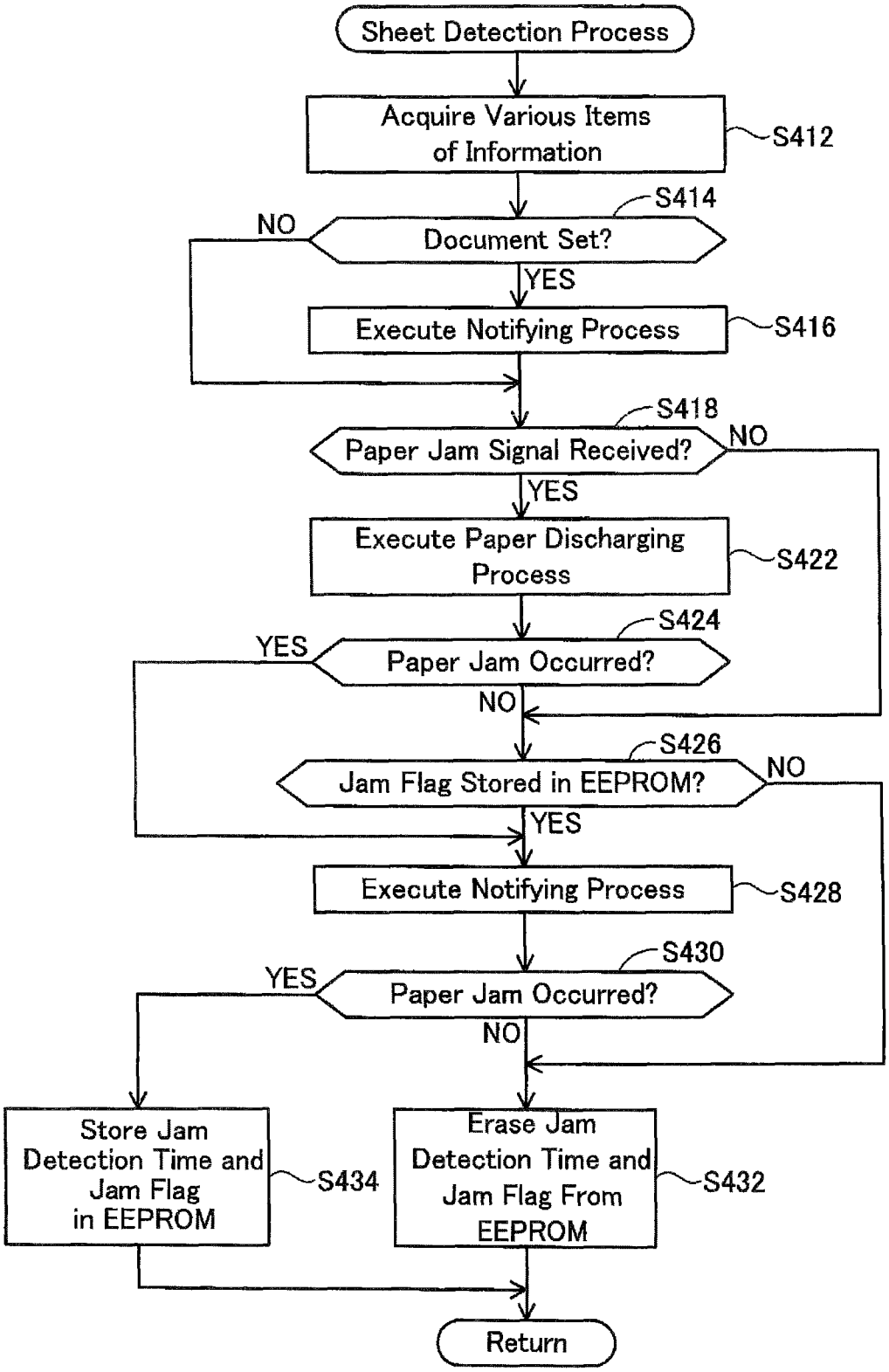

The sheet detection process performed in S128 and 5134 will be described with reference to FIG. 8. In S412, the CPU 320 acquires various items of information from the document sensor 336, the document front-end sensor 337, and the registration sensor 338. In S414, the CPU 320 determines whether the signal SS3 indicating that a document is set on an automatic document feeder (not shown) has been received from the document sensor 336. When the document is not set (S414: NO), the flow proceeds to S418. When the document is set (S414: YES), the flow proceeds to S416. In S416, the CPU 320 executes a notifying process of outputting a message to the user, indicating that a document is set on an automatic document feeder (not shown). The notifying process may display a character string "Document Is Set," for example, on the touch panel 334. The notifying process may be performed for a predetermined period.

In S418, the CPU 320 judges whether the signal SS4 is received from the document front-end sensor 337, or whether the signal SS5 is received from the registration sensor 338. The signal SS4 is a signal indicating that a front end of a document is present at a reading position. The signal SS5 is a signal indicating that a front end of a recording sheet is present at a printing position. When these signals are not received (S418: NO), the flow proceeds to S426. On the other hand, when these signals are received (S418: YES), it is judged that a document or a recording sheet is present in the middle of a transport path (a paper jam has occurred), and the flow proceeds to S422. In S422, the CPU 320 drives the paper feed motor 131 or the automatic document feed motor 132 to execute a paper discharging process.

In S424, the CPU 320 judges again whether the signal SS4 is received from the document front-end sensor 337, or whether the signal SS5 is received from the registration sensor 338. When one of the signals is received (S424: YES), it is judged that a paper jam of a document or a recording sheet still remains present, and the flow proceeds to S428. On the other hand, when these signals are not received (S424: NO), the flow proceeds to S426. In S426, the CPU 320 judges whether a jam flag is stored in the EEPROM 282. When the jam flag is not stored (S426: NO), it is judged that a paper jam of a document or a recording sheet has not occurred, and the flow proceeds to S432. On the other hand, when the jam flag is stored (S426: YES), it is judged that a paper jam of a document or a recording sheet has occurred, and the flow proceeds to S428. In S428, the CPU 320 executes a notifying process of outputting a message to the user, indicating that the paper jam of a document or a recording sheet has occurred. The notifying process may display a character string "Paper Jam Has Occurred," for example, on the touch panel 334. The notifying process may be performed for a predetermined period.

In S430, the CPU 320 judges again whether the signal SS4 is received from the document front-end sensor 337, or whether the signal SS5 is received from the registration sensor 338. When one of the signals is received (S430: YES), it is judged that the paper jam of a document or a recording sheet still remains present, and the flow proceeds to S434. In S434, the CPU 320 temporarily stores a jam detection time (for example, after 15 minutes) in the EEPROM 282 as a candidate for the apparatus information detection time that is to be stored in the counter 314. Moreover, the CPU 320 stores the jam flag in the EEPROM 282.

On the other hand, when these signals are not received (S430: NO), it is judged that the paper jam of a document or a recording sheet has not occurred, and the flow proceeds to S432. In S432, the CPU 320 erases the jam flag from the EEPROM 282. Moreover, the CPU 320 erases the jam detection time temporarily stored in the EEPROM 282. In this way, the flow ends.

Figure 9:
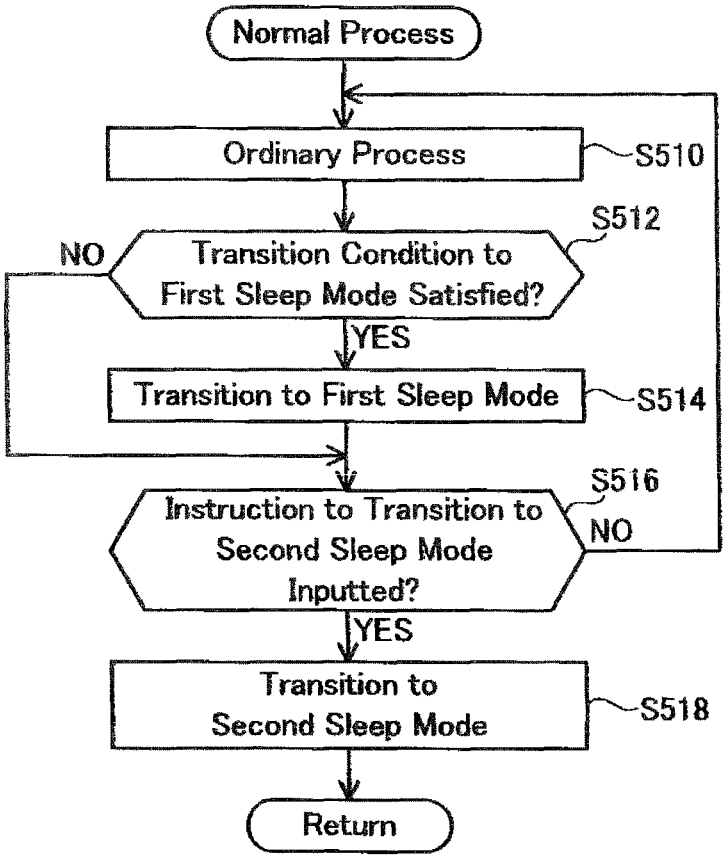

The normal process (S34) will be described with reference to FIG. 9. In S510, the CPU 320 executes an ordinary process. A printing process is an example of the ordinary process. In S512, the CPU 320 judges whether a transition condition to transition to the first sleep mode is satisfied. An example of the transition condition is a case where a predetermined period has elapsed with no instruction input to the image forming apparatus 1. When the transition condition is not satisfied (S512: NO), the flow proceeds to S516. When the transition condition is satisfied (S512: YES), the flow proceeds to S514. In S514, the CPU 320 causes the 8V sleep generation module 321 to output the 8V sleep signal SLEEP2 to the power unit 301. As a result, the image forming apparatus 1 enters the first sleep mode from the normal mode. After that, the flow proceeds to S516.

In S516, the CPU 320 judges whether an input of an instruction to transition to the second sleep mode has been accepted. The input of the instruction to transition to the second sleep mode may be accepted via the power switch 331, for example. When the input of the transition instruction is not accepted (S516: NO), the flow returns to S510. When the input of the transition instruction is accepted (S516: YES), the flow proceeds to S518. In S518, the CPU 320 causes the 0V sleep generation module 322 to output the 0V sleep signal SLEEP1 to the power unit 301. As a result, the image forming apparatus 1 enters the second sleep mode from the first sleep mode. In this way, the flow ends.

<Advantages>

The advantages of the image forming apparatus 1 disclosed in this specification will be described. According to the image forming apparatus 1, when the image forming apparatus 1 is in the second sleep mode (a mode where no electric power is supplied from the power unit 301), the RTC unit 310 can monitor the image forming apparatus 1 with the electric power supplied from the capacitor 302. Due to this, in a period where the image forming apparatus 1 is not used, since the image forming apparatus 1 can be driven with only the electric power supplied from the capacitor 302 without receiving the electric power from the power unit 301, it is possible to further save power consumption.

When the state of the image forming apparatus 1 is changed (S214 and 5314: YES), the I/F connection change time (S224) or the mismounting setting time (S324) is used as the apparatus information detection time that is to be stored in the counter 314. Moreover, the apparatus information detection time (I/F connection change time, mismounting setting time, or the like) when the state of the image forming apparatus 1 is changed is set to a cycle that is shorter than that of the apparatus information detection time (ink temperature detection time, periodic maintenance time, or the like) when the state of the image forming apparatus 1 is not changed. Thus, the frequency in which the image forming apparatus 1 enters the normal mode from the second sleep mode can be increased in the case where the state of the image forming apparatus 1 is changed as compared to the case where the state of the image forming apparatus 1 is not changed. Due to this, when the state of the image forming apparatus 1 is changed (a case where the apparatus state needs to be monitored), the information on the image forming apparatus 1 can be acquired more frequently (S212 and S312). Thus, it is possible to switch between control that puts a higher priority to power saving and control that puts a higher priority to monitoring the state of the image forming apparatus 1, according to the state of the image forming apparatus 1.

In the image forming apparatus 1, the I/F connection change flag (S224) indicating that the change in the I/F connection has not been dealt with and the cartridge change flag (S324) indicating that the ink cartridge 340 is not properly mounted can be stored in the EEPROM 282. Thus, in a case where the change in the I/F connection has not been dealt with and the ink cartridge 340 is mismounted (that is, when the apparatus state needs to be monitored) (S216 and S316), it is possible to monitor the apparatus state of the image forming apparatus 1 more frequently, by increasing the frequency in which the image forming apparatus 1 enters the normal mode from the second sleep mode The viscosity of the ink stored in the ink cartridge 340 increases as the temperature decreases, and ink clogging in the recording head 11 is likely to occur. In the image forming apparatus 1, the lower the ink temperature, the higher the frequency in which the image forming apparatus enters the normal mode in order to execute the maintenance process can be set (S118). As a result, it is possible to more effectively prevent the occurrence of ink clogging in the recording head 11.

An electric double-layer capacitor is used as the capacitor 302. Since the electric double-layer capacitor does not entail movement of ions during charging, it is possible to complete charging quicker as compared to the use of secondary batteries or the like. Thus, the charging of the capacitor 302 can be completed in a period in which the image forming apparatus 1 enters the normal mode or the first sleep mode and executes another process. As a result, it is possible to eliminate the need to maintain the image forming apparatus 1 in the normal mode or the first sleep mode in order to charge the capacitor 302 only and to further save the power consumption.

<Modifications>

Modifications of the above embodiment will be described below. The information measured in S116 is not limited to the ink temperature. Information (room temperature, humidity, or the like) on the environment of the image forming apparatus 1 may be measured. Moreover, the periodic maintenance time may be adjusted (S118) taking room temperature or humidity into consideration. By doing so, it is possible to prevent the occurrence of ink clogging in the recording head 11 more effectively.

A variety of methods of updating the periodic maintenance time based on the ink temperature may be used in S118. For example, an updating method in which the interval between the previous periodic maintenance time and the next periodic maintenance time is set longer with higher ink temperature may be used.

The method of detecting completion of charging of the capacitor 302 in S20 is not limited to a method which uses the charge period, and various other methods can be used. For example, when the capacitor residual level detection module 304 detects that the residual charge level of the capacitor 302 has become larger than a predetermined level, the completion of charging of the capacitor 302 may be detected, and the charge flag may be erased (S22).

Although it has been described that the flow of FIG. 3 starts when the image forming apparatus 1 enters the normal mode from the second sleep mode, the present invention is not limited to such an embodiment. The flow of FIG. 3 may start when the image forming apparatus 1 enters the first sleep mode from the second sleep mode. Moreover, when there is a need to execute a process (sheet detection process, see FIG. 8) which requires the operation of the paper feed motor 131 to the carriage motor 134 or a process (periodic maintenance process, see FIG. 5) which requires the operation of the recording head 11, the image forming apparatus 1 may enter the normal mode from the first sleep mode.

A variety of methods of storing various apparatus information detection times in the register of the counter 314 may be used. For example, various apparatus information detection times may be stored as a counter value.

In this embodiment, although a case where the present invention is applied to an ink jet image forming apparatus has been described as an example, the present invention is not limited to this. The present invention is not limited to the image forming apparatus but can be applied to control circuits of various apparatuses.

What is claimed is:

1. An image forming apparatus that is configured to enter a first state where electric power is supplied from a power supply to various circuits and a second state where no electric power is supplied from the power supply to the circuits, the image forming apparatus comprising:

a capacitor connected to the power supply, and charged by the power supply in a period where the image forming apparatus is in the first state; and a controller connected to the capacitor, the controller operating with electric power supplied from the capacitor when the image forming apparatus is in the second state, and the controller operating with electric power supplied from the power supply when the image forming apparatus is in the first state, wherein the controller is configured to perform:

(A) causing the image forming apparatus to enter the first state from the second state upon detecting that the image forming apparatus satisfies a predetermined condition when the image forming apparatus is in the second state;

(B) reading instruction information stored in a memory after the image forming apparatus has entered the first state;

(C) acquiring related information relating to the image forming apparatus when the instruction information instructs to acquire the related information; and (D) causing the image forming apparatus to enter the second state after the above (C).

2. The image forming apparatus according to claim 1, wherein the controller is further configured to perform:

(E) various items of operations in the first state, wherein the controller is configured not to perform the various items of operations in the second state, and the controller is configured to perform only the above (A) in the second state.

3. The image forming apparatus according to claim 1, wherein the controller is configured to perform the above (D) by sending, to the power supply, a stop signal for stopping the supply of electric power.

4. The image forming apparatus according to claim 1, further comprising:

a sensor that operates in the first state, wherein the related information includes apparatus information detected by the sensor.

5. The image forming apparatus according to claim 4, wherein the memory stores the apparatus information that has been acquired in the latest above (C), the controller comprises a counter, the above (A) includes detecting that the image forming apparatus satisfies the predetermined condition upon an elapse of an apparatus information detection period set in the counter, and the controller is further configured to perform:

(F) changing the apparatus information detection period from a first period to a second period which is shorter than the first period, if in a state where first apparatus information is being stored in the memory, second apparatus information which is different from the first apparatus information is acquired, wherein the second apparatus information is information that is acquired when the first period has elapsed and the image forming apparatus has entered the first state; and (G) causing the image forming apparatus to enter the second state after the above (F).

6. The image forming apparatus according to claim 5, wherein the above (F) includes causing the memory to store change information indicating a change in the apparatus information, if the second apparatus information is acquired.

7. The image forming apparatus according to claim 6, wherein the above (F) includes maintaining the second period, if in a state where the second apparatus information is being stored in the memory, the second apparatus information is acquired, and the change information is stored in the memory.

8. The image forming apparatus according to claim 5, wherein the related information includes environment information of the image forming apparatus, and the environment information is acquired in the first state.

9. The image forming apparatus according to claim 8, further comprising:

an ink cartridge that contains ink used in image formation; and a recording head that discharges the ink, wherein the environment information includes a temperature of the ink contained in the ink cartridge, the above (F) includes changing the apparatus information detection period to be shorter as the measured temperature of the ink is lower, the above (A) includes detecting that the image forming apparatus satisfies the predetermined condition upon an elapse of the apparatus information detection period, and the controller is further configured to perform:

(H) performing a maintenance process of the recording head according to the instruction information when the instruction information indicates maintenance.

10. The image forming apparatus according to claim 1, wherein the above (A) includes detecting that, in the second state, the image forming apparatus is in any one of a plurality of states including the predetermined state, the above (A) includes causing the image forming apparatus to enter the first state upon detecting that the image forming apparatus is in any one of the plurality of states, and the above (B) includes reading the instruction information stored in the memory when the state detected by the above (A) is the predetermined state where a predetermined period has elapsed.

11. An image forming apparatus that is configured to enter a first state where electric power is supplied from a power unit to various circuits and a second state where no electric power is supplied from the power unit to the circuits, the image forming apparatus comprising:

a capacitor that is connected to the power unit, and charged by the power unit in a period where the image forming apparatus is in the first state;

a monitoring unit that is connected to the capacitor, and operates with electric power supplied from the capacitor when the image forming apparatus is in the second state; and a control unit that operates with electric power supplied from the power unit when the image forming apparatus is in the first state, wherein the monitoring unit causes the image forming apparatus to enter the first state from the second state upon detecting that the image forming apparatus satisfies a predetermined condition when the image forming apparatus is in the second state, the control unit reads instruction information stored in a storage unit after the image forming apparatus has entered the first state, and when the instruction information instructs to acquire related information relating to the image forming apparatus, the control unit acquires the related information and, after acquiring the related information, causes the image forming apparatus to enter the second state.

* * * * *